US007500282B1

(12) United States Patent
Park

(10) Patent No.: US 7,500,282 B1
(45) Date of Patent: Mar. 10, 2009

(54) MODULAR SYSTEM FOR STIMULATION AND EXFOLIATION OF HUMAN SKIN

(76) Inventor: Stewart B. Park, 920 S. Monroe St., San Jose, CA (US) 95128

( * ) Notice: Subject to any disclaimer, the term of this patent is extended or adjusted under 35 U.S.C. 154(b) by 579 days.

(21) Appl. No.: 10/318,490

(22) Filed: Dec. 13, 2002

(51) Int. Cl.
*A47L 7/00* (2006.01)

(52) U.S. Cl. ..... 15/160; 15/186; 15/187; 15/188; 601/136; 4/606

(58) Field of Classification Search ..... 15/160, 15/186–188, DIG. 5; 601/136; 4/606; *A47L 7/00*
See application file for complete search history.

(56) References Cited

U.S. PATENT DOCUMENTS 2,795,807 A * 6/1957 Salvy ..... 15/176.1
2,851,713 A * 9/1958 Tupper ..... 15/105
3,843,991 A * 10/1974 Vallis ..... 15/167.3
4,128,910 A * 12/1978 Nakata et al. ..... 15/110
4,943,018 A * 7/1990 Glaser et al. ..... 248/110
5,228,165 A * 7/1993 Westberry et al. ..... 15/160
5,628,082 A * 5/1997 Moskovich ..... 15/110
5,926,900 A * 7/1999 Bennett ..... 15/167.1
6,735,808 B2 * 5/2004 Chen ..... 15/110

* cited by examiner

*Primary Examiner*—David A Redding
(74) *Attorney, Agent, or Firm*—Jones, Tullar & Cooper, PC

(57) ABSTRACT

Presented is a device having a unitary body molded from synthetic resinous material and including a base member having a central mounting recess on its back side for receiving the mounting stud of a suction cup. On its front side the device is provided with a multiplicity of rows of spaced elastically resilient "prongs", or a multiplicity of "tuft" like projections each formed of many different thin filaments, or a multiplicity of "rod" like projections the distal ends of which are semi-spherical or "rounded" and useful for applying deep massaging pressure to the skin for stimulation thereof. Integrally formed on the base member are mounting flanges having integral mounting lugs and mounting apertures for detachably interconnecting one such device to a similarly constructed adjacent device to selectively form a specifically arranged configuration or array embodying a multitude of the devices.

17 Claims, 7 Drawing Sheets

FIG. 5
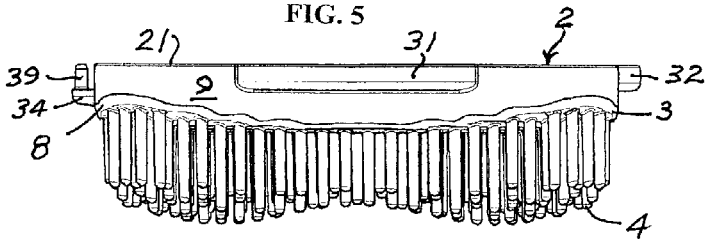
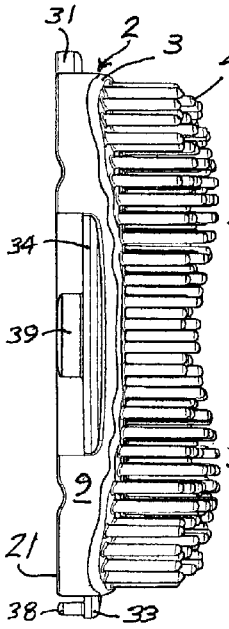
FIG. 2
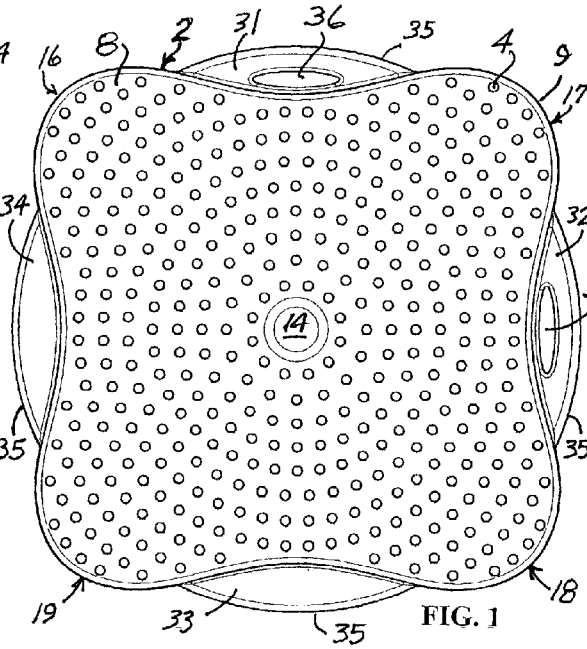
FIG. 1
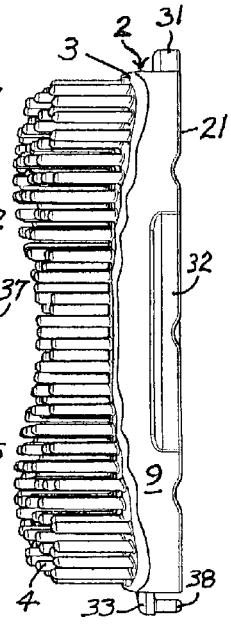
FIG. 3
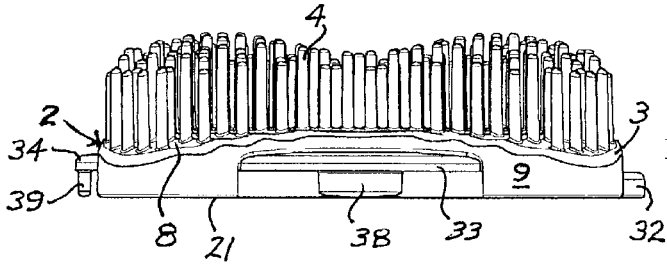
FIG. 4

MODULAR SYSTEM FOR STIMULATION AND EXFOLIATION OF HUMAN SKIN

BACKGROUND OF THE INVENTION

1. Field of the Invention

This invention relates to a means and method of stimulating human skin, particularly while a person is bathing and applicable particularly to stimulate and exfoliate the skin on a person's back.

2. Description of the Prior Art

The skin that covers the human body is one of the most important organs of the human body. The human skin lies in three layers: epidermis, dermis and subcutaneous fat. The purpose of the instant invention is exfoliation and preservation of the health of the epidermis, believed to be the front line of defense for the human body. Stated in other words, the skin, draped over the human body, forms the barrier between what's inside the body and what's outside the body. It protects the human body from a multitude of external forces. It is known that the outer layer of the epidermis comprises a protective covering called the stratum corneum and consists of fifteen to forty layers of flattened skin cells, or corneocytes that have migrated up from deeper regions and which replace themselves about once a month. It is for the purpose of cleansing the skin of these discarded corneocytes and preserving the health of the skin that the present invention has been designed.

A preliminary patentability and novelty search has revealed the existence of the following United States patents which, in one way or another, are useful for scrubbing or massaging the human body. None of these patents appear to disclose the novel structure of the instant invention as described, illustrated and claimed herein.

| | | | |
|---|---|---|---|
| 4,047,259 | 4,053,960 | 4,704,759 | 5,277,389 |
| 5,600,864 | 5,628,083 | 5,774,907 | 5,784,722 |
| 6,053,464 | 6,227,742 | 6,370,722 | D-344,633 |
| D-354,587 | D-388,547 | D-400,658 | D-403,119 |
| D-444,916 | | | 5,779,653 |

One of the important objects of the present invention is the provision of a device that is simple to fabricate by injection molding in a configuration that enables it to be detachably mounted on a bathroom wall or a shower wall and useful for massaging, scrubbing or exfoliating the skin on a person's back during the process of bathing, but which may be used as a hand-held device for massaging, scrubbing or exfoliating other areas of the human body whether during the bathing process or apart from the bathing process.

Another object of the invention is the provision of a scrubbing or exfoliating device the working face of which is undulated and formed from independent and elastically resilient "prongs" or projections of different lengths so as to enable the massaging, scrubbing or exfoliation of surfaces of the human body that are irregular, such as, by way of example, the hip area, shoulders, shoulder blades, hollow of the back, elbows, knees or heel areas of the feet.

Still another object of the invention is the provision of a scrubbing device designed and configured to cooperate with and to be detachably interconnected with other like devices to form a variety of differently configured arrays formed by a multitude of interconnected scrubbing devices.

Yet another object of the invention is the provision of a scrubbing and exfoliating device provided with independent and spaced "prongs" arranged in concentric circular patterns or other selected pattern and formed of different lengths within each pattern to enable the user to use a selected amount of pressure on the prongs or elastically resilient projections to secure different intensities of pressure and scrubbing or exfoliation action on selected areas of the skin.

The invention possesses other objects and features of advantage, some of which, with the foregoing, will become apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the massaging, scrubbing, stimulating and exfoliation device forming the subject matter of this invention comprises a unitary body preferably injection molded from an appropriate synthetic resinous material possessing elastic resilience and including a base member formed on its back side with a central recess for receiving the mounting stud of a suction cup and formed on its opposite or front side with a multiplicity of concentrically arranged rows of independent elastically resilient "prongs", or a multiplicity of "tuft" like projections, each formed of many different thin filaments, similar to the tufts in a toothbrush, or a multiplicity of "rod" like projections the distal ends of which are semi-spherical or "rounded" and more appropriately used for applying deep massaging pressure to the skin for stimulation thereof rather then scrubbing or exfoliating it and selectively having varying lengths to provide an overall undulating characteristic to the distal ends of the elastically resilient "prongs", "tufts" or "rods" or uniform lengths. Integrally formed on the base are means for detachably interconnecting one such device to a similarly constructed adjacent device to selectively form a specifically arranged configuration or array embodying a multitude of the devices, the array being arranged for detachable mounting on the wall of a shower or bathtub enclosure, or on any appropriate flat surface against which a person wishes to mount the array or a single device for the purpose of stimulating, exfoliating, scrubbing or massaging a selected area of the body. In this latter use, the device may be equipped with an appropriate elongated handle detachably secured to the base, or provided with a strap-like member under which the hand can be inserted to facilitate manipulation of the single device for imposing a scrubbing, exfoliation or massaging motion and pressure on the device and through the device on the underlying skin.

BRIEF DESCRIPTION OF THE DRAWINGS

FIG. 1 is a top plan view of the front or operating face of the scrubbing and exfoliating device shown apart from any supporting structure.

FIG. 2 is a left side or edge elevational view of the scrubbing and exfoliating device.

FIG. 3 is a right side or edge elevational view of the device.

FIG. 4 is a bottom edge elevational view of the device.

FIG. 5 is a top edge elevational view of the device.

DETAILED DESCRIPTION OF THE INVENTION

Figure 6:
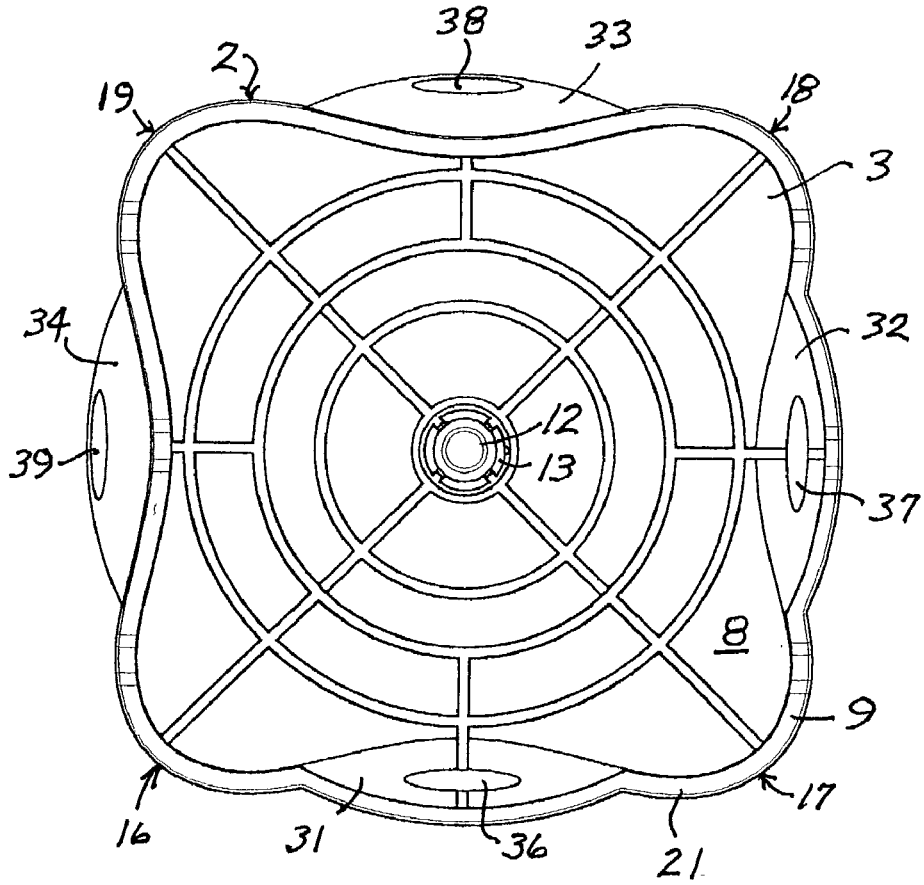
FIG. 6 is a bottom plan view showing the back side of the device opposite the operating face of the device as illustrated in FIG. 1.

In terms of greater detail and referring to the drawings, it will be seen that the scrubbing and exfoliation device of the invention is conveniently formed by injection molding of a suitable synthetic resinous material, preferably a thermoplastic such as, by way of example, high-density polyethylene, low-density polyethylene, polypropylene, cellulose acetate, vinyl, cellulose acetate butyrate and other thermoplastics such as "Nylon" and polymethyl methacrylate sold under the trademarks "Lucite" or "Plexiglas". Other suitable embodiments of the invention, using other materials and other methods of manufacture and use of the device may of course be utilized without departing from the spirit of the invention as will be hereinafter explained.

It is a matter of common knowledge that many people, perhaps most, take their skin for granted, giving little or no thought to its care and preservation. It has been estimated that if an adult human took off his skin and laid it flat, it would cover an area of about twenty-one (21) square feet. Visually, that would be a membrane three feet wide and seven feet long, about the size of beach towels on which many people lie in the sun to literally "cook" their skin to a darkened shade. Thus, the skin that covers the human body is by far the body's largest organ. The human skin forms a "highway" to our most intimate and psychological selves. This impervious yet permeable barrier, less than a millimeter thick in places, is composed of three layers, as explained above. The outermost layer is the bloodless epidermis. The intermediate layer is the dermis that includes collagen, elastin and nerve endings, while the innermost layer is subcutaneous fat that functions to provide an energy source, cushion and insulator for the body. A neuroscientist and associate director of the Institute for Sensory Research at Syracuse University has stated: "In simple terms people perceive three basic things via skin: pressure, temperature and pain." Perceptions of pressure, temperature and pain manifest themselves in many different ways. Gentle stimulation of pressure receptors can result in ticklishness, gentle stimulation of pain receptors in itching. Both sensations arise from a neurological transmission rather than from something that physically exists. As stated by the neuroscientist referred to above: "When the nerve cells are stimulated, physical energy is transformed into energy used by the nervous system and passed from the skin to the spinal cord and brain. It's called transduction, and no one knows exactly how it takes place." It is believed however that the process involves the intricate, split-second operation of a complex system of signals between neurons in the skin and brain.

It is for the purpose of enhancing all of these sensory advantages between the skin and the brain of humans and for the stimulation and preservation of the human skin that the stimulating, massaging, scrubbing and exfoliating device of this invention was designed. As seen in the drawings, the device is formed by a body designated generally by the numeral 2 and includes a base member designated generally by the numeral 3 from which project a multiplicity of integral generally perpendicular and spaced resiliently elastic "prongs" 4 (FIGS. 1-14) or a multiplicity of spaced "tufts" 6 (FIGS. 15 and 16) secured to and projecting from the base, or a multiplicity of integral relatively stiff but resiliently flexible spaced "rods" 7 (FIGS. 17 and 18) projecting from the base and preferably injection molded from one of the synthetic resinous materials identified above in the case of the "prongs" 4 and "rods" 7, or otherwise secured to the base in the case of the "tufts" 6 which are preferably formed from the gathering into a bundle of individually formed synthetic resinous filaments of small diameter which when gathered together and anchored in the base form a "tuft" that is pliant and relatively soft to the touch when brushed across the skin.

Figure 8:
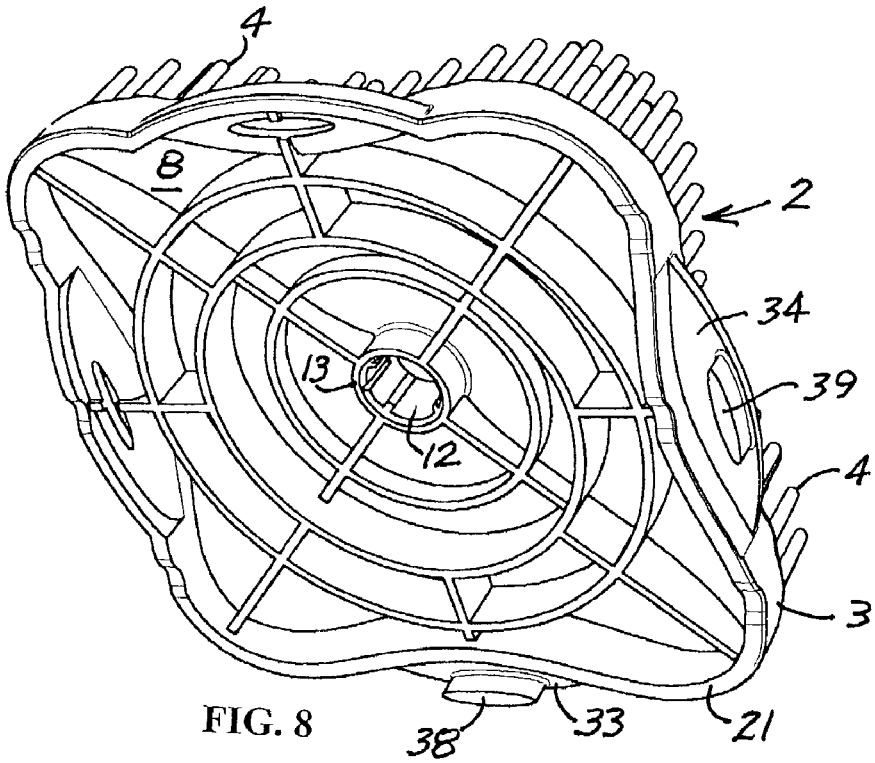
FIG. 8 is a perspective view of the back side of the device illustrating the central recess for receiving a suction cup. In the interest of clarity the suction cup is not shown.
Figure 7:
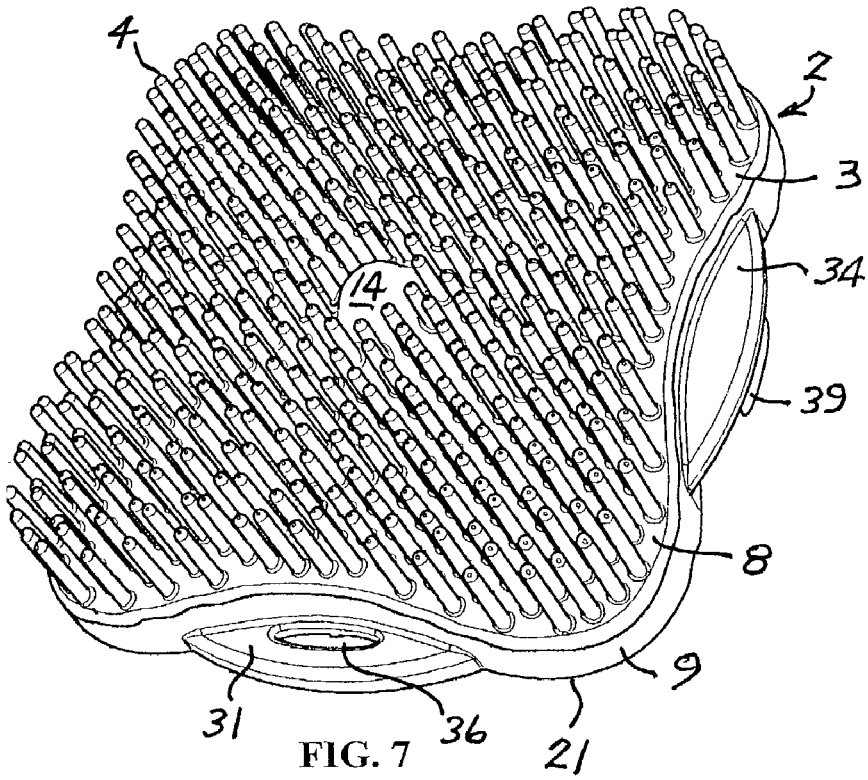
FIG. 7 is a perspective view of the device illustrating the arrangement of exfoliating and scrubbing "prongs" or projections.
Figure 9:
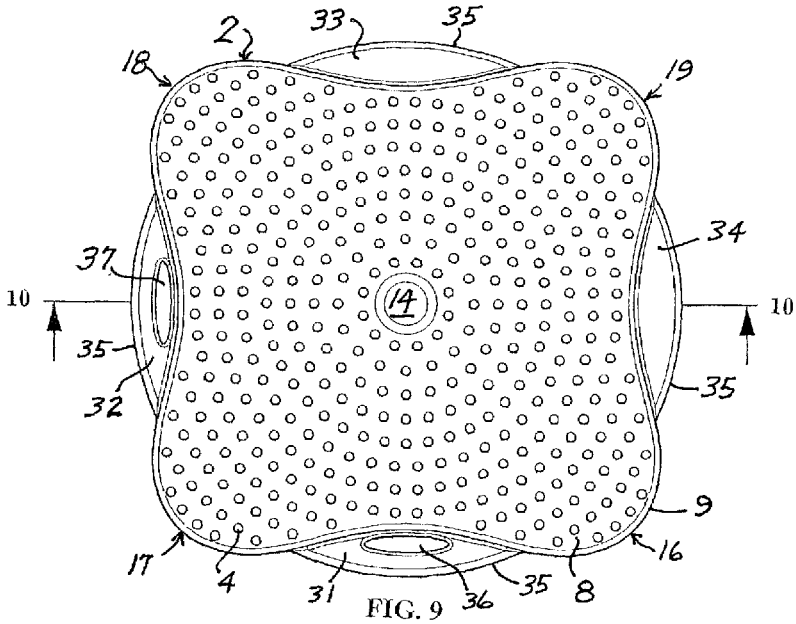
FIG. 9 is a top plan view similar to FIG. 1 but rotated counter-clockwise 90°.

Referring to FIGS. 6 and 8, it will be seen that the base 3 is formed by and includes a plate portion 8 that is integral with a peripheral flange 9 both of which are generally symmetrical about a central axis, with laterally opposite portions of the plate portion 8 and the integral peripheral flange 9 being offset radially inwardly toward the central axis to provide smooth arcuate indentations at 90° intervals about the body. The plate portion 8 is provided with a central mounting recess 12 preferably open at its bottom end as shown in FIGS. 6 and 8 and closed at its upper end as shown in FIG. 7, the recess being formed by an integral cylindrical wall 13 that projects below the bottom surface of the plate portion and projects beyond the top surface thereof to terminate in a closed end 14 which defines a button as seen in FIGS. 7, 9, 10 and 11 of the drawings. The closed end or button 14 is useful as a location where digital pressure may be applied to detachably mount a fastener in the recess 12.

Figure 18:
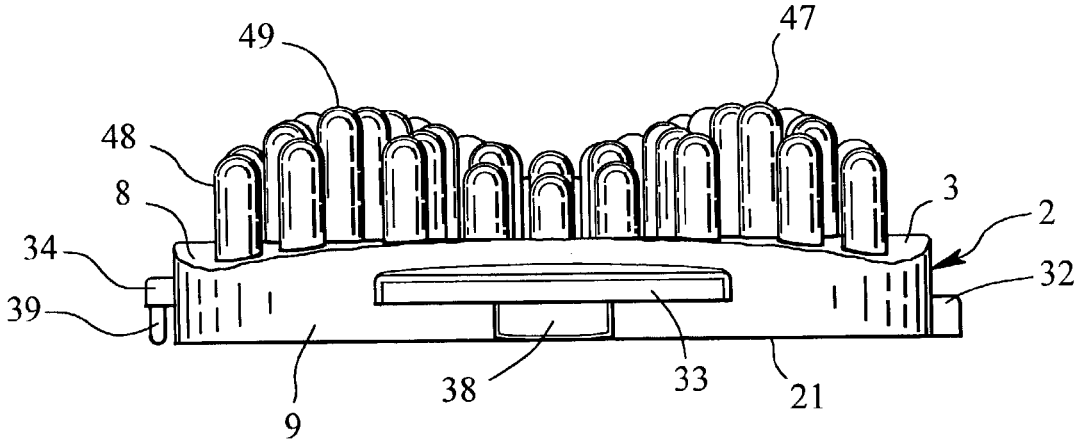
FIG. 18 is a top edge elevational view of the third embodiment of the device illustrated in FIG. 17, taken in the direction of the arrow 18 in FIG. 17.

Referring to FIGS. 1, 2, 3, 4 and 5 of the drawings, it will be seen that the plate portion 8 of the base 3 undulates between each of the four rounded or arcuate corners 16, 17, 18 and 19 and the central portion of the plate portion at which the central mounting recess 12 and the cylindrical wall 13 with a closed button end 14 are positioned. Stated another way, while the bottom edge 21 of the peripheral flange 9 is coincident with a single plane, the plate portion 8 rises perceptibly from each of the arcuate corners 16, 17, 18 and 19 toward the central axis and closed button end 14 to define a sloping 90° quadrant that then descends or slopes downward from adjacent the central axis and the closed button end 14 of the cylindrical wall toward the adjacent corners on opposite sides thereof. It will be seen from the drawings that each of the arcuate corners is associated with a sloping 90° quadrant as described above. From the drawings it will be seen that the resiliently elastic "prongs" of FIGS. 1-14, the "tufts" of FIG. 16 and the "rods" of FIG. 18 are distributed in spaced relation to one another over the entire upper surface of the plate portion 8 and are arranged in progressively increasing circular and arcuate patterns spaced radially from the central axis of the body and from the associated circular and arcuate patterns of projections, be they "prongs", "tufts" or "rods".

Again referring to the drawings, it will be seen from FIGS. 2, 3, 4 and 5 that the resiliently elastic "prongs" integrally projecting from the plate portion 8 are of different lengths. Thus, referring to the four 90° quadrants discussed above that define the upper surface of the plate portion 8, it will be seen from the drawings that with respect to each quadrant the arcuate pattern of integral "prongs" projecting from each corner portion commence with an outer or first arcuate row of multiple "prongs" of equal length, say nominally 15 mm in length. The second radially inwardly spaced arcuate row of multiple "prongs" in each quadrant contains "prongs" of different lengths, the two "prongs" at opposite ends of the row and alternately on opposite sides of intermediate "prongs" being approximately 10 mm in length, while the intermediate "prongs" are approximately 18 mm in length. This pattern of alternately arranged short and long "prongs" is continued in the radially inwardly spaced concentric rows of "prongs" so that collectively the distal ends of the "prongs" define an undulating surface that in each quadrant rises from a minimum height at the arcuate corner to a maximum height approximately midway between the arcuate corner and the central axis as shown in the drawings. Controlling the lengths of the "prongs" in this manner provides a generally depressed area defined by the distal ends of "prongs" surrounding the closed button end 14 of cylindrical wall 13 and from such closed end wall radiating laterally outwardly toward the lateral edges of the plate portion, thus enhancing use of the device to stimulate, massage, scrub and exfoliate pointed or projecting areas of the body such as shoulder blades, elbows, knees and heels, while enabling the same procedure over larger and flat or slightly recessed areas of the back and hollow areas of the body. Additionally, the distribution of short and long "prongs" through the multiple concentric rows thereof enables the application of selected differential pressure, i.e. more or less pressure, on the body of the device to effect engagement of more or less of the "prongs" with the surface of the skin and with differential pressure being applied to the skin by shorter and longer "prongs" to secure different degrees of stimulation of the skin.

As thus described the device may be used by holding it in one hand and drawing it across a selected area of the body to stimulate the skin be it by massage, by scrubbing to cleanse the skin or by scrubbing to exfoliate dead skin cells from the surface of the skin. Used in this manner it may be easily and conveniently held in the palm of one hand by letting the fingers grasp the periphery of the flange 9 and directing the movement and engagement of the "prongs" on the skin with selective pressure. Where desired, a strap (not shown) having a mounting stud centrally positioned and push-to-engage and peel-to-disengage fasteners on opposite end portions may be detachably mounted on the device by forcing the mounting stud into the central mounting recess 12 and the strap wrapped about the back of the hand and the interengageable fasteners engaged to retain the device detachably secured to the hand.

The device, singly or in multiple numbers, may also be mounted on the wall of a shower stall, or on the wall above a bathtub so that a person bathing may place his (or her) body against the device and, by rotational and vertical motions of the body, effect stimulation, massage, scrubbing or exfoliation of a given area of the body without the use of hands. For use in this manner, the central recess 12 of the body frictionally yet detachably receives the mounting stud 22 of a conventional suction cup 23 (shown in broken lines in FIG. 10 in a detached attitude in the interest of clarity) and the suction cup after being detachably secured to the device is then detachably secured to a selected wall surface in the usual manner by digital pressure applied to the button 14 to flatten the suction cup against the support structure. In this regard, it will be understood that conventional suction cups are formed from a flexible material such as rubber or plastic, are usually circular and are formed with a concave surface which when applied to a flat wall surface flattens to expel air from between the concave surface of the suction cup and the flat wall surface to thus detachably secure (detachably stick) the suction cup to the wall surface.

Figure 10:
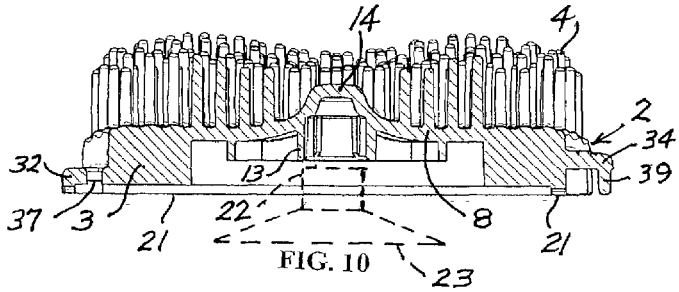
FIG. 10 is a vertical cross-sectional view taken in the plane indicated by the line 10-10 in FIG. 9.
Figure 11:
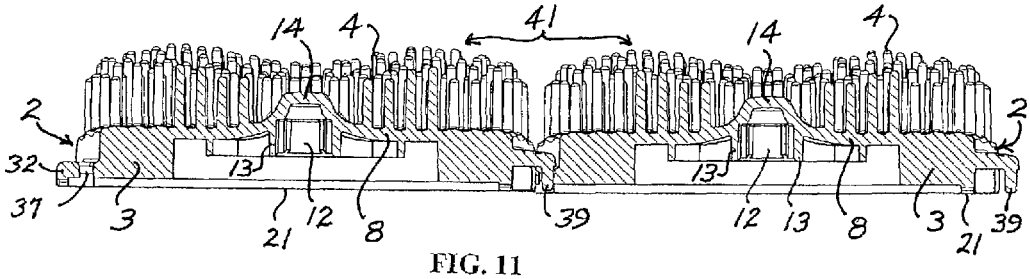
FIG. 11 is a vertical cross-sectional view illustrating the manner and means by which two adjacent devices are detachably secured together.

As illustrated in FIG. 10 in broken lines (albeit detached), the suction cup 23 is attached to the back side of the device by pressing a finger on the concave surface of the suction cup and another finger on the button 14 and forcing the mounting stud 22 into the central mounting recess 12 formed by the cylindrical wall 13. The length of the mounting stud 22 and the depth of the central mounting recess 12 are dimensioned so that when the suction cup 23 is flattened against a flat wall, the edge 21 of the flange 9 abuts the flat wall, thus providing stability to the device, now detachably secured to the flat wall. The frictional fit of the mounting stud 22 in the central mounting recess 12 formed by the cylindrical wall 13 provides another important and unique advantage to the user, that of easy removal of the device from a wall for purposes of cleaning either the wall or device, or rearrangement into another desired interconnected pattern. When the user desires to remove the device he grasps the outer edges of the base unit with his fingers and pulls it away from the wall. The frictional fit of the mounting stud 22 in recess 12 allows the base device to be pulled free from the suction cup while the suction cup remains detachably attached to the wall because the force retaining the suction cup to the wall is greater than the frictional force retaining the stud in the recess 12. Once this is accomplished and the suction cup, still attached to the wall, is revealed, it is an easy matter to remove the suction cup by lifting one edge of its rim to break the suction force between the cup and the wall. Reinstallation of the suction cup 23 onto the base unit is then easily accomplished by the method described above. Alternatively, if desired, the suction cup now attached to the back side of the device, instead of being detachably secured to a flat wall surface as described above, may instead be detachably secured to a flat surface on an elongated handle (not shown) and the device then manipulated by hand to stimulate, massage, scrub and exfoliate areas of the body more easily reached through use of the device equipped with a detachable handle. It will thus be understood that the massaging, scrubbing and exfoliating device of the invention lends itself to being used in several different modes of operation, each to accomplish the end result of conveniently and effectively stimulating, massaging, scrubbing and exfoliating the skin over selected areas of the body of the person manipulating the device.

Figure 12:
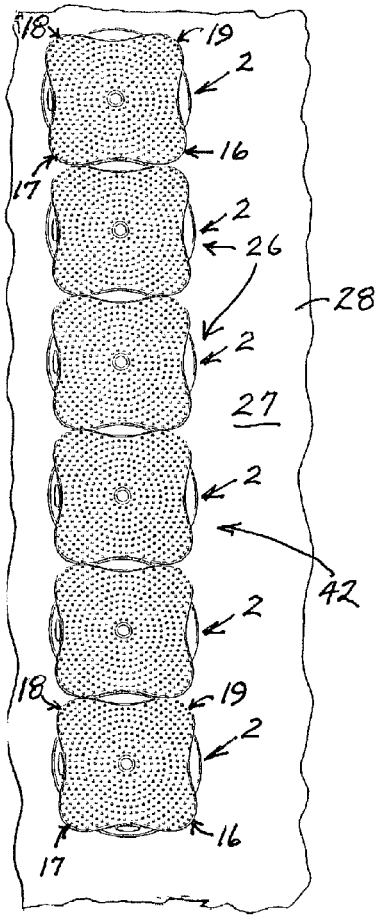
FIG. 12 is a front elevational view illustrating six of the detachably inter-engaging scrubbing devices secured in a vertical array to a wall structure such as a shower enclosure.
Figure 13:
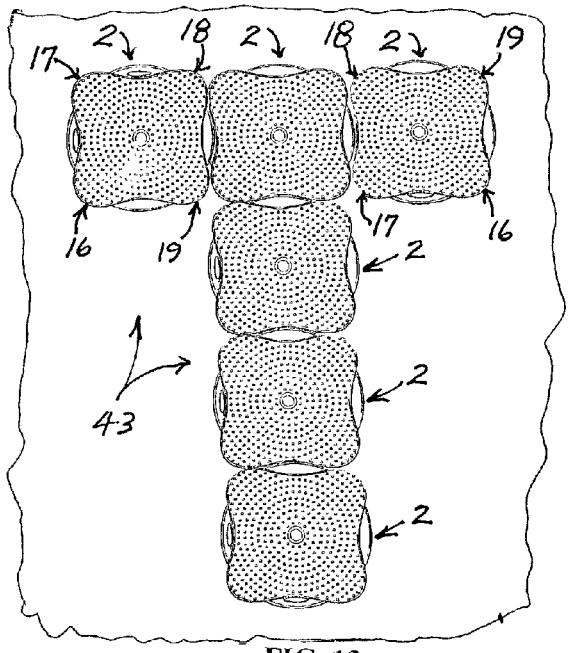
FIG. 13 is a front elevational view illustrating six of the detachably inter-engaged scrubbing devices secured in a "T" pattern array to a wall structure.
Figure 14:
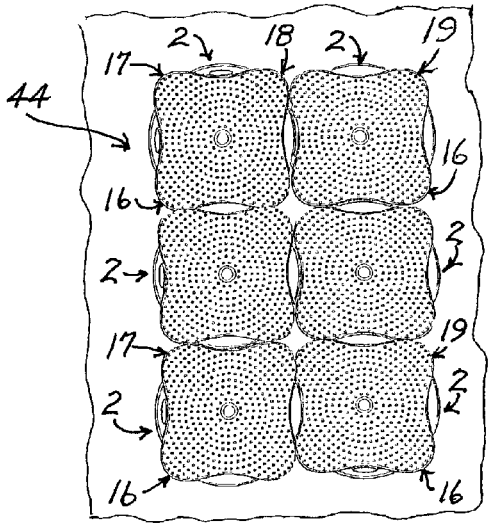
FIG. 14 is a front elevational view illustrating six of the detachably inter-engaged scrubbing devices secured in a rectangular pattern array to a supporting wall structure.

Referring to FIGS. 12, 13 and 14, it will be seen that multiple devices may be detachably interconnected in various desirable arrays or patterns to achieve different effects or to facilitate the use and function of the device by different people having different physical limitations. Multiple units thus detachably interconnected and detachably attached to a shower wall, for instance, provide greater stability and resistance to lateral displacement by the pressure applied to the array by the user. In FIG. 12 it is seen that six identical devices as described above and illustrated in the drawings in FIGS. 1 through 11, inclusive, are arranged vertically in an array designated generally by the numeral 26, detachably secured to one another and each detachably secured to the flat surface 27 of a flat wall 28 through use of suction cups as described above. To implement each device to enable detachable interconnection of multiple devices, reference is made to FIGS. 1, 6, 8, 10 and 11 of the drawings. As there illustrated and as previously discussed, the body 2 of the device is provided with a peripheral flange 9. Projecting laterally (perpendicularly) from the peripheral flange at four 90° intervals about the device are integral mounting flanges 31, 32, 33 and 34, each of the mounting flanges having an outer edge 35 curved to match the curvature of the radially inward curvature of the peripheral flange 9 at the locations of the mounting flanges.

Formed in the mounting flange 31 is an ovate aperture 36 with one edge of the aperture lying closely adjacent the associated sidewall of the flange 9 as shown. In like manner the mounting flange 32 is provided with an ovate aperture 37 similarly positioned with one edge of the aperture closely adjacent the associated sidewall of the flange 9. The mounting flange 33, on the other hand, is provided with an integral mounting lug 38 positioned on the flange in a position closely adjacent the outer edge of the flange. In like manner, the flange 34 is also provided with an integral mounting lug 39 positioned closely to the outer edge of the mounting flange 34. The mounting lugs 38 and 39 are shaped to conform closely to the shape of the ovate apertures 36 and 37 for a reason that will hereinafter be explained. Suffice to say that the mounting lugs 38 and 39 are integrally formed on and project perpendicularly from the mounting flanges 33 and 34 and are dimensioned and configured to engagingly project into the ovate apertures 36 and 37 in a snug frictional yet detachable engagement.

It will thus be seen that when two or more of the identical devices are arranged in differently configured arrays 41, 42, 43 and 44, respectively, as shown in FIGS. 11, 12, 13 and 14, the mounting lug of one of the devices will penetrate and detachably engage with the ovate aperture in the associated device, and the outer periphery of the curved mounting flange on which a mounting lug is formed will abut the curved associated surface of the peripheral flange 9 next adjacent the ovate aperture in the underlying mounting flange having an aperture penetrated by a mounting lug. In this manner any number desired of the devices may be detachably interconnected one with another of the identical devices to form the arrays illustrated or other selected arrays of different configuration to provide the lateral stability of the array as described above.

In the embodiments of the invention illustrated in FIGS. 15 through 18, inclusive, the body of the device is fabricated in the same configuration and is provided with the same peripheral flange 9 and the same mounting flanges provided with similar ovate apertures and mounting lugs and accordingly the same reference numerals are utilized in connection with these embodiments to designate similar elements. Referring to the embodiment illustrated in FIGS. 15 and 16, the only difference of this embodiment from that illustrated in FIGS. 1-14 is that the plate portion 8 is provided with "tufts" 46 arranged in a similar concentric pattern but with fewer concentric rows because the "tufts" are somewhat larger than the integral "prongs" of FIGS. 1-14. In this embodiment the "tufts" 46 are each formed from a multiplicity of individual strands or filaments 47 of natural fiber or synthetic resinous (plastic) filamentary material gathered together to form the "tuft" and then one end of the "tuft" is embedded and permanently secured in the plate portion 8. These "tufts" provide a softer scrubbing or exfoliating effect when applied to the skin and are useful for those individuals that have a particularly sensitive skin.

Figure 17:
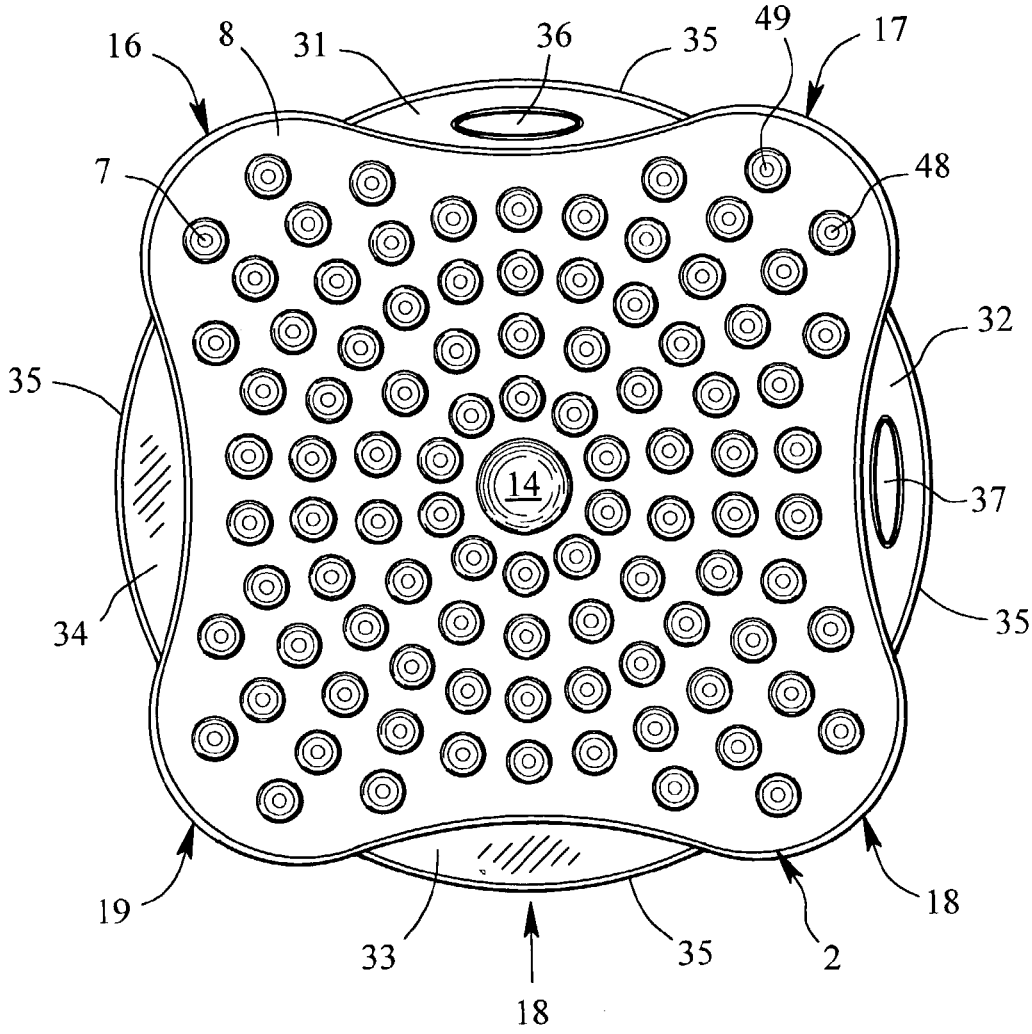
FIG. 17 is a top plan view similar to FIGS. 9 and 15 but illustrating a third embodiment of the invention in which the elastically flexible elongated elements of the device that contact the skin are larger in diameter than the "prongs" of FIG. 1 and therefore less flexible and are provided with a rounded distal end effective for applying gentle pressure during a massage procedure to effect deep stimulation of the skin in all of its layers.

Referring to the embodiment of the invention illustrated in FIGS. 17 and 18, it will be seen from the illustration that the body 3 of this device is identical to the body of the device illustrated in FIGS. 1-14, including the flange 9 and the radially projecting mounting flanges 31, 32, 33 and 34 and the ovate apertures and mounting lugs associated with the respective mounting flanges as previously discussed. Again, the only difference in structure is the nature of the "projections" or "rods" 48 which, in this instance, are integral with the plate portion 8 and are of larger diameter than the "prongs" of FIGS. 1-14. Another difference is that the distal ends 49 of the rods 48 are rounded or semi-spherical so as to impose a gentle pressure over a larger area of the skin when the device is used and pressure is applied to effect a massaging motion of the device. The semi-spherical or rounded ends of the rods are spaced apart as shown, and the lengths of the rods are varied as previously discussed so as to provide the undulating configuration discussed above in connection with the embodiment of FIG. 1 or, in the alternative, the distal ends of the rods may terminate in a common plane. The rods, while being larger in diameter, are nevertheless resiliently elastic and capable of flexing when downward pressure is applied and lateral motion of the device is affected over the surface of the skin. Because of the larger diameter and the semi-spherical distal ends of the rods, however, the effect is more to massage the skin and underlying tissue rather than scrub or exfoliate the skin, although at least some exfoliation will occur.

Figure 15:
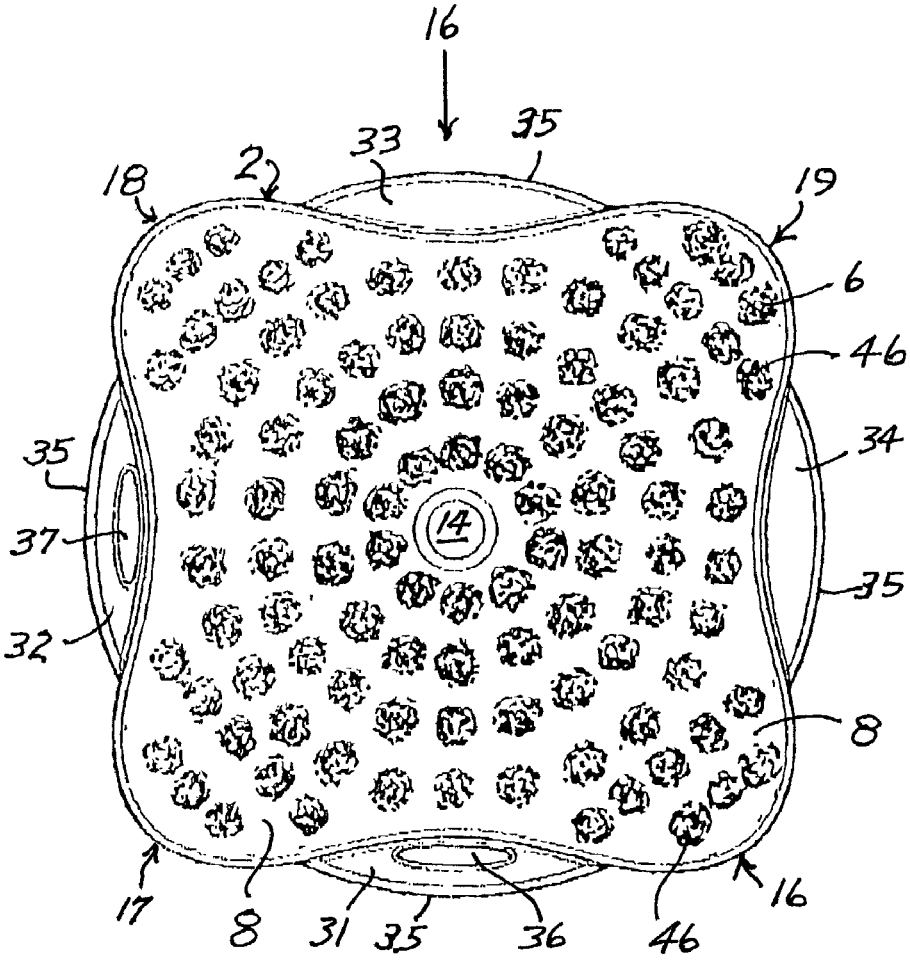
FIG. 15 is a top plan view similar to FIG. 9 but illustrating a second embodiment in which the scrubbing and exfoliating elements of the device, instead of individual "prongs", constitute multiple individual "tufts" formed from multiple elongated filaments enabling a softer more gentle engagement of the device with the skin.
Figure 16:
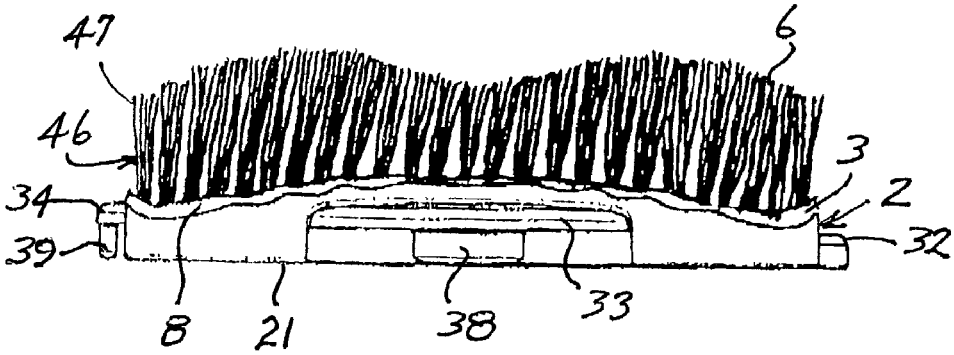
FIG. 16 is a top edge elevational view of the second embodiment device illustrated in FIG. 15, taken in the direction of arrow 16.

While the nature of the "tufts" and "rods" of the embodiments illustrated in FIGS. 15/16 and FIGS. 17/18 are different from the "prongs" of FIG. 1, the structure of the bodies of these embodiments is identical, thus enabling multiple such devices to be detachably interconnected in the same manner and in the same and different configurations as illustrated in FIGS. 12, 13 and 14. Additionally, while "prongs" and "tufts" of different lengths are illustrated and described, it should be understood that the "prongs" and "tufts" may be of equal length so long as the structure of the body with which they are integral or to which they are secured and from which they project enables multiple such devices to be detachably interconnected in the manner illustrated in FIGS. 12, 13 and 14.

Having thus described the invention, what is believed to be new and novel and sought to be protected by Letters Patent of the United States is as set forth in the claims.

I claim:

1. A modular system for stimulation, massaging, exfoliation and scrubbing of human skin comprising:

a) a unitary body including a base member having a plate portion including a top surface, a bottom surface and a peripheral flange projecting below said bottom surface;

integral mounting flanges on said peripheral flange and projecting therefrom at 90° intervals;

means on said integral mounting flanges for detachably interconnecting an additional unitary body to each of said integral mounting flanges;

b) a multiplicity of spaced elongated flexible members projecting from said top surface of the plate portion in a direction opposite to the projection of said peripheral flange whereby the distal ends of said elongated flexible members define a surface useful for stimulating, massaging, exfoliating and scrubbing skin surfaces of a human body; and c) wherein said base member is symmetrical about a central axis and means are provided detachably secured on said base member adjacent said bottom surface for detachably securing said unitary body to a supporting surface.

2. The modular system according to claim 1, wherein said unitary body is formed from resiliently elastic synthetic resinous material and the distal ends of said elongated flexible members define an undulated plane having peaks and valleys useful for stimulating, massaging, exfoliating and scrubbing irregular surfaces of a human body.

3. The modular system according to claim 1, wherein said multiplicity of elongated flexible members are of different lengths and are integral with the plate portion from which they project.

4. The modular system according to claim 1, wherein said means for detachably interconnecting an additional unitary body to each of said integral mounting flanges comprises mounting lugs projecting perpendicularly from two adjacent mounting flanges, and wherein two adjacent ones of said mounting flanges are each provided with a mounting aperture, the configuration of said mounting lugs and said mounting apertures enabling detachable interconnection of the mounting lug of one unitary body with a mounting aperture of another adjacent unitary body.

5. The modular system according to claim 4, wherein said one unitary body is detachably interconnected in combination with a multiplicity of additional identical unitary bodies detachably connected to form an array thereof.

6. The modular system according to claim 5, wherein said multiplicity of additional identical unitary bodies are detachably interconnected to selected mounting flanges on said one unitary body and selectively detachably interconnected to selected mounting flanges on said additional identical unitary bodies to control the direction in which the array extends.

7. The modular system according to claim 3, wherein said spaced elongated flexible members of different lengths vary in length from about 10 mm to about 18 mm and taper from a selected first dimension at their proximate ends integral with said plate portion to a second lesser dimension at their distal ends.

8. The modular systems according to claim 1, wherein said elongated resiliently flexible members projecting from said top surface of said plate portion are bundles of multiple filaments gathered to form "tufts" and one end of each said "tufts is secured to said plate portion.

9. The modular system according to claim 1, wherein said elongated resiliently flexible members projecting from said top surface of said plate portion are rods and one end of each said rod is secured to said plate portion.

10. The modular system according to claim 1, wherein said elongated flexible members are elastically flexible and normally extend from the top surface of said plate portion parallel to adjacent elongated flexible members.

11. A modular system for stimulation, massaging, exfoliation and scrubbing of human skin comprising:

a) a unitary body including a base member having a plate portion including a top surface, a bottom surface and a peripheral flange projecting below said bottom surface, said peripheral flange defining a recess adjacent the bottom surface of said plate portion, and reinforcement ribs integrally formed on, and extending from the bottom surface of said plate portion and integrally connected with said peripheral flange;

b) a multiplicity of spaced elongated flexible members projecting from said top surface of the plate portion in a direction opposite to the projection of said peripheral flange whereby the distal ends of said elongated flexible members define a surface useful for stimulating, massaging, exfoliating and scrubbing skin surfaces of a human body; and c) wherein said base member is symmetrical about a central axis and means are provided detachably secured on said base member adjacent said bottom surface for detachably securing said unitary body to a supporting surface.

12. The modular system according to claim 11, wherein a first plurality of said reinforcement ribs are concentrically arranged within said peripheral flange, and a second plurality of said reinforcement ribs extend diametrically of said concentric ribs.

13. The modular system according to claim 12, wherein the innermost of said concentrically arranged reinforcement ribs defines a mounting recess open at one end and closed at the opposite end to form a button, and a suction cup including a mounting stud and a tapered skirt portion is detachably secured to said base member by insertion of said mounting stud into said mounting recess by digital pressure applied to said button.

14. A modular system for stimulation, massaging, exfoliation and scrubbing of human skin in combination with a support structure, comprising:

a flat wall surface forming said support structure;

a plurality of unitary bodies each having a base member having a plate portion including a top surface, a bottom surface and an outer periphery detachably interconnected to the outer periphery of an adjacent unitary body to form an array thereof arranged in a selected pattern;

a multiplicity of spaced elongated flexible members projecting from said top surface whereby the distal ends of said elongated flexible members define a surface useful for stimulating massaging, exfoliating and scrubbing surfaces of a human body; and means detachably mounted on each of said plurality of unitary bodies and detachably secured to said flat wall surface of said support structure to detachably support said array of unitary bodies on said flat surface of said support structure.

15. The combination according to claim 14, wherein each of said unitary bodies is generally symmetrical about a central axis and mounting flanges project perpendicularly from the periphery of said unitary body at 90° intervals, and a mounting flange of one unitary body is detachably secured to the mounting flange of an associated adjacent unitary body.

16. The combination according to claim 14, wherein said multiplicity of spaced elongated flexible members are of different lengths and are integral with said top surface of each unitary body whereby the distal ends of said elongated flexible members of different lengths define an undulated plane having peaks and valleys useful for stimulating, massaging, exfoliating and scrubbing irregular surfaces of a human body.

17. A modular system for stimulation, massaging, exfoliation and scrubbing of human skin comprising:

a) a unitary body including a base member having a plate portion including a top surface, a bottom surface and a peripheral flange projecting below said bottom surface, said unitary body being formed from synthetic resinous material and said peripheral flange being integral with said unitary body and having a bottom edge lying in a plane, the top surface of the plate portion defining an undulated surface having peaks and valleys in relation to the plane coincident with said bottom edge of said peripheral flange;

b) a multiplicity of spaced elongated flexible members projecting from said top surface of the plate portion in a direction opposite to the projection of said peripheral flange whereby the distal ends of said elongated flexible members define a surface useful for stimulating, massaging, exfoliating and scrubbing skin surfaces of a human body; and c) wherein said base member is symmetrical about a central axis and means are provided detachably secured on said base member adjacent said bottom surface for detachably securing said unitary body to a supporting surface.

* * * * *